US005129691A

United States Patent [19]

McFarlen

[11] Patent Number: 5,129,691

[45] Date of Patent: Jul. 14, 1992

[54] GATE LATCH CONTROL DEVICE

[76] Inventor: Jonn McFarlen, 5514 Holland Street, Vancouver, British Columbia, Canada, V6N 2A8

[21] Appl. No.: 747,511

[22] Filed: Aug. 20, 1991

[51] Int. Cl.[5] ..... E05C 3/26

[52] U.S. Cl. ..... 292/214; 292/244

[58] Field of Search ..... 292/227, 299, 127, 170, 292/238, 235, 237, 244

[56] References Cited

U.S. PATENT DOCUMENTS

| | | | |
|---|---|---|---|
| 37,567 | 2/1863 | Cooper . | |
| 289,666 | 12/1883 | Lee | 292/227 X |
| 1,235,560 | 8/1917 | Deloatch . | |
| 1,324,428 | 12/1919 | Mair . | |
| 1,591,383 | 7/1926 | Herzing . | |
| 1,662,119 | 3/1928 | Lewis | 292/127 |
| 1,703,556 | 2/1929 | Stewart | 292/127 |
| 2,190,080 | 2/1940 | Ott | 292/227 X |
| 2,627,433 | 2/1953 | Wolfe . | |
| 3,266,831 | 8/1966 | Banse . | |
| 3,433,518 | 3/1969 | Foltz . | |

FOREIGN PATENT DOCUMENTS

| | | | |
|---|---|---|---|
| 279139 | 10/1930 | Italy | 292/135 |

*Primary Examiner*—Richard E. Moore

*Attorney, Agent, or Firm*—Barrigar & Oyen

[57] ABSTRACT

A gate latch control device for controlling opening and closing of a gate latch fixed to a gate post. The device incorporates a rod which is mounted for slidable displacement through the gate post, with opposed ends of the rod protruding from opposite sides of the gate post. A slot is provided in the rod for slidable passage of the gate latch through the slot. One end of the slot contacts and pivotally displaces the gate latch when the rod is slidably displaced from a closed position into an open position.

4 Claims, 3 Drawing Sheets

GATE LATCH CONTROL DEVICE

FIELD OF THE INVENTION

This application is directed to a device for controlling opening and closing of a gate latch from either side of the gate post on which the latch is mounted.

BACKGROUND OF THE INVENTION

Gates of the type employed in residential fences commonly utilize inexpensive gate latches available from most hardware stores. Typically, such latches incorporate a latch bolt which is fastened to the gate; and, a pivotable latching member which is fastened to the gate post, in alignment with the latch bolt. When the gate is closed, the latch bolt is forced past the latch plate, which then drops into position over the latch bolt, thus capturing the latch bolt and holding the gate in the closed position. To open the gate one lifts the latch plate clear of the latch bolt, thereby allowing the latch bolt to swing clear of the latch plate when a force is applied to open the gate.

Problems are encountered if it is desired to open the gate from the side opposite that to which the latch mechanism is fastened. If the gate is sufficiently short, then a tall person may be able to reach over the top of the gate and lift the latch member, thereby freeing the latch bolt and allowing the gate to be opened. However, this technique is often not a viable option. An alternative technique which is sometimes employed is to cut a hole in the gate proximate to the latch bolt. The hole is made sufficiently large that a person's hand may pass through the hole to open the latch as aforesaid. However, this technique is undesirable because it may weaken the gate and degrade the gate's appearance.

Another prior art technique is to pivotally attach a rod to the side of the gate, near the latch, such that opposed ends of the rod project outwardly from either side of the gate, when the gate is closed A short length of string or chain couples the latch plate to the rod end which projects outwardly on the latch side of the gate. A person wishing to open the gate from the side opposite the latch pivots the rod, thereby lifting the latch plate and freeing the latch bolt so that the gate can be opened.

Another frequently employed technique is to drill a hole through the gate post. One end of a piece of string, rope, cord, chain, etc. is fixed to the latch plate. The opposite end is threaded through the gate post hole and left hanging from the side of the gate post opposite that to which the latch plate is fastened. A person wishing to open the gate from the side opposite the latch may pull the hanging string, thereby lifting the latch plate and freeing the latch bolt so that the gate can be opened. Various embodiments of this "string pull" technique are disclosed in U.S. Pat. No. 1,235,560 issued Aug. 7, 1917 for an invention of Deloatch entitled "Gate Latch"; U.S. Pat. No. 3,266,831 issued Aug 16, 1966 for an invention of Banse entitled "Automatic Latch"; and in U.S. Pat. No. 3,433,518 issued Mar. 18, 1969 for an invention of Foltz entitled "Latch Assembly".

The "string pull" technique is relatively unsophisticated and prone to breakage of the string. The prior art has however evolved a variety of "push-pull" rod type mechanisms for controlling the opening and closing of gate or door latches. For example, U.S. Pat. No. 37,567 issued Feb. 3, 1863 for an invention of Cooper entitled "Door Latch" discloses a mechanism in which a rod is connected between handles provided on opposite sides of a door. The rod is connected to a door latch mechanism to enable the latch to be opened or closed by pushing or pulling either of the handles, depending upon the side from which the door is to be opened. U.S. Pat. No. 1,591,383 issued July 6, 1926 for an invention of Herzing entitled "Closure Latch"; and, U.S. Pat. No. 2,627,433 issued Feb. 3, 1953 for an invention of Wolfe entitled "Door Latch" disclose other "push-pull" rod type mechanisms comparable to that of Cooper.

Although providing more positive control over the latch mechanism than the "string pull" technique, the "push-pull" rod techniques exemplified by Cooper, Herzing and Wolfe are directed to use with specific latch mechanisms. More particularly, these prior art arrangements are unsuited to use with the commonly used gate latch described above. The present invention provides a gate latch control device specifically adapted for use with such gate latches.

SUMMARY OF THE INVENTION

In accordance with the preferred embodiment, the invention provides a gate latch control device for controlling opening and closing of a gate latch fixed to a gate post. The device incorporates a rod which is mounted for slidable displacement through the gate post, with opposed ends of the rod protruding from opposite sides of the gate post. A slot is provided in the rod for slidable passage of the gate latch through the slot. One end of the slot contacts and pivotally displaces the gate latch when the rod is slidably displaced from a closed position into an open position.

The end of the slot which contacts the gate latch is preferably sloped. Advantageously, handles are provided on each of the opposed ends of the rod.

DETAILED DESCRIPTION OF THE PREFERRED EMBODIMENT

Figure 1:
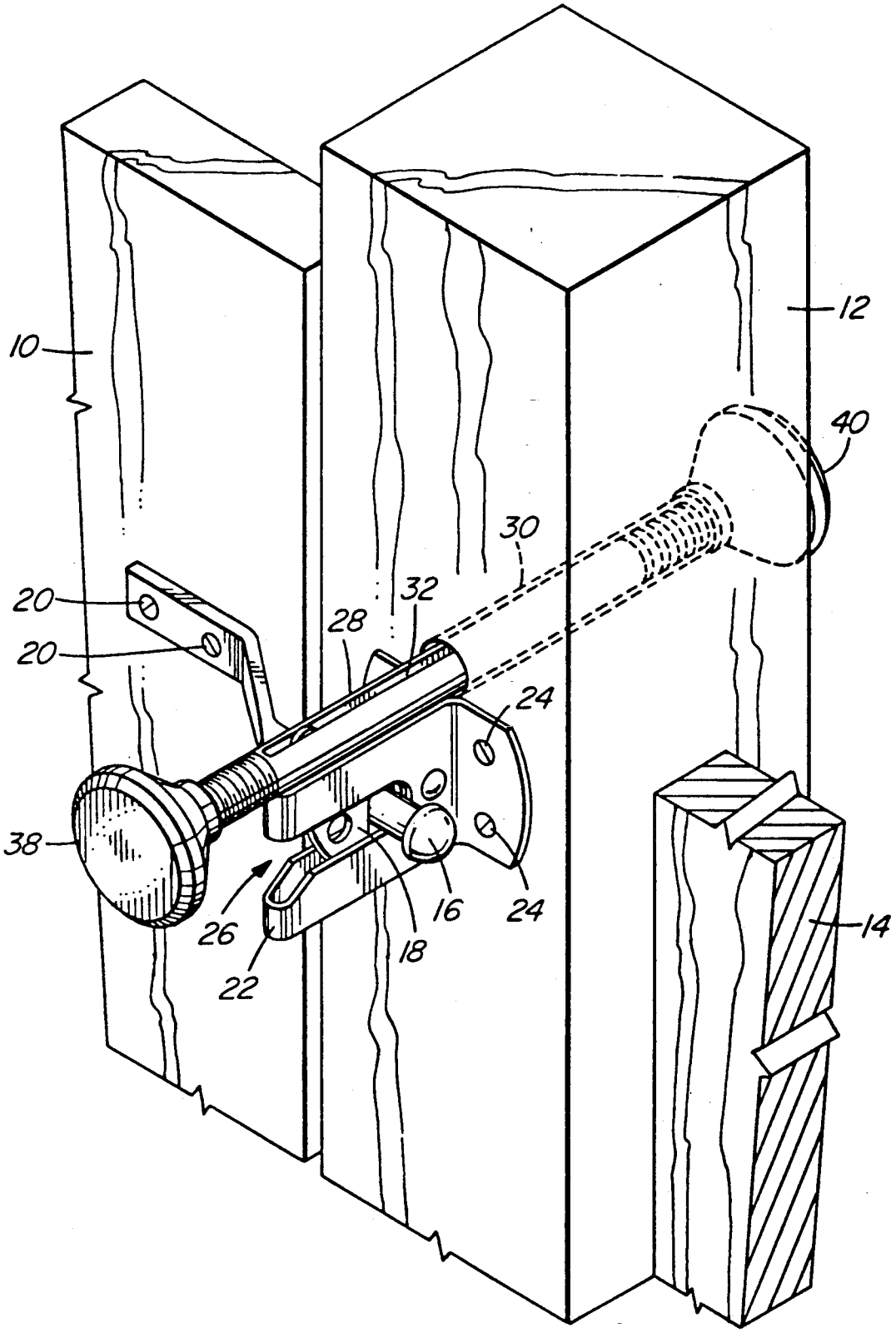
FIG. 1 is a pictorial illustration of a gate latch control device constructed in accordance with the preferred embodiment of the invention and installed in a gate post for use in conjunction with a gate latch.

The drawings illustrate portions of a gate 10, gate post 12 and fence 14. A conventional gate latch mechanism consisting of a latch bolt 16 and a pivotable latch plate 18 are also shown. Latch bolt 16 is fastened to gate 10 by means of screws 20. Latch plate 18 is pivotally mounted within holder 22, which is in turn fastened to gate post 12 with the aid of screws 24. Care is taken to align latch bolt 16 so that it will pass freely through aperture 26 of holder 22 as gate 10 is opened and closed.

As is well understood, gate 10 is opened by lifting latch plate 18 upwardly so that it does not obstruct slot 26. This allows latch bolt 16 to swing clear of latch plate 18 when force is applied to open gate 10. Conversely, when force is applied to close gate 10, the leading edge of latch bolt 16 strikes the forward edge of latch plate 18, forcing latch plate 18 to pivot upwardly, clear of slot 26. This allows continued passage of latch bolt 16 through slot 26, toward gate post 12. Once latch bolt 16 passes the trailing edge of latch plate 18, the force of gravity causes latch plate 18 to drop downwardly through slot 26, thereby capturing latch bolt 16 and holding gate 10 in the closed position illustrated in the drawings.

The present invention comprises a rigid rod 28 formed of plastic, nylon, metal or similar tough material. A hole 30 is bored through gate post 12. Hole 30 is made just large enough to allow rod 28 to slide freely back and forth through hole 30.

Figure 2:
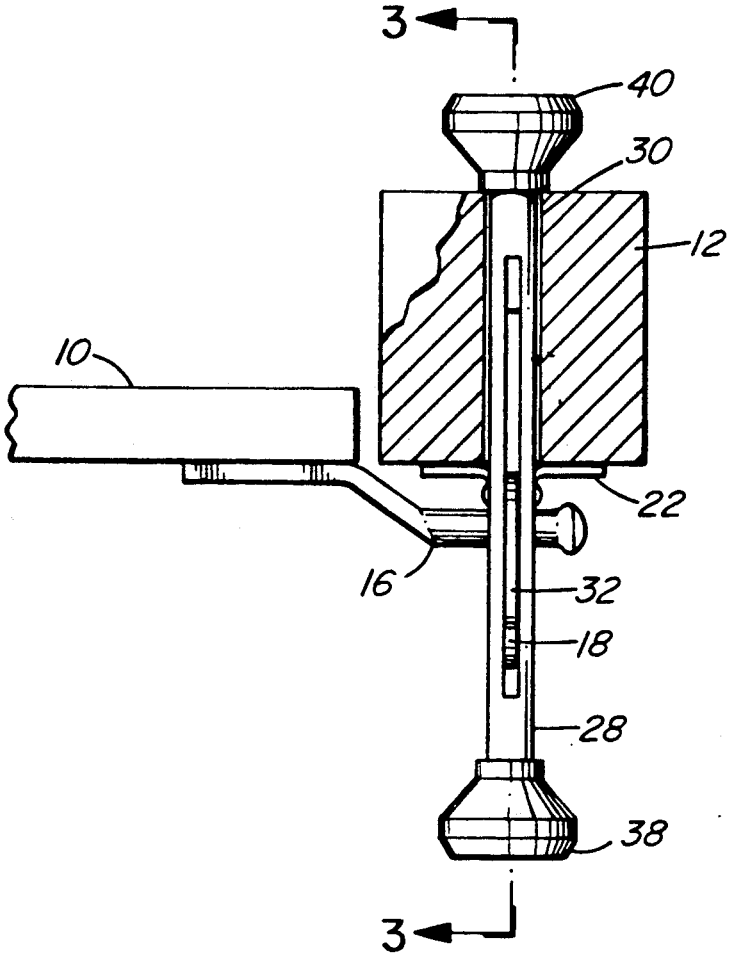
FIG. 2 is a top view in which most of the upper portion of the gate post has been cut away to better illustrate the gate latch control device.
Figure 3:
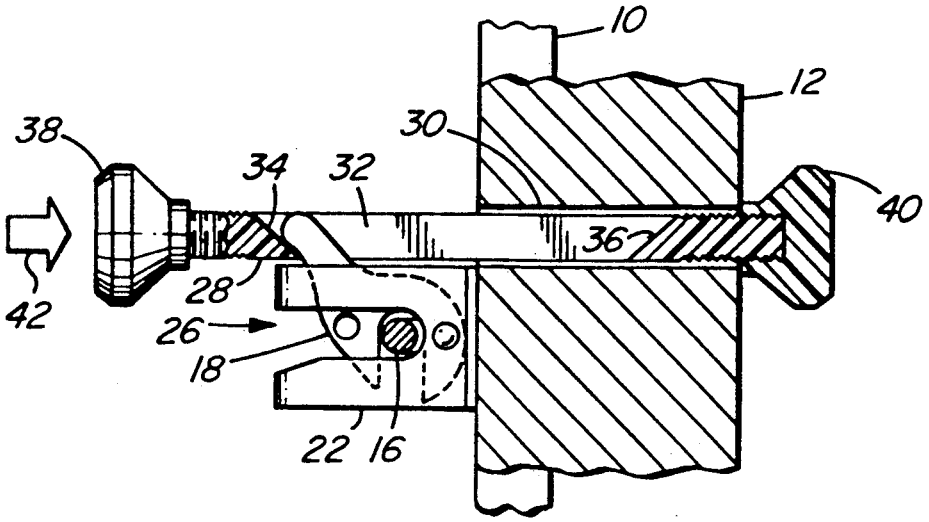
FIG. 3 is a cross-sectional view taken with respect to lines 3—3 of FIG. 2.
Figure 4:
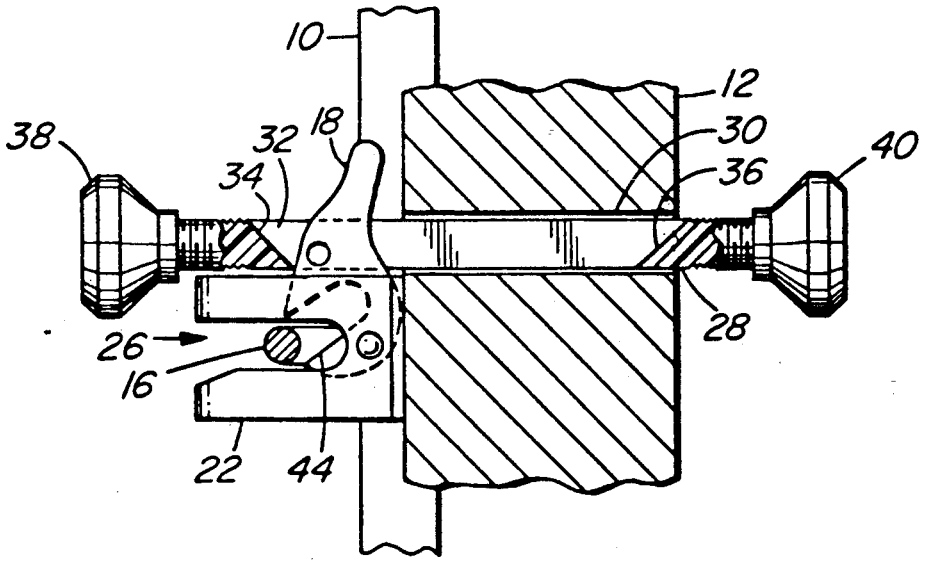
FIG. 4 is similar to FIG. 3, but shows the device after it has been actuated to open the gate latch.

A narrow slot 32 (best seen in FIG. 2) is provided in rod 28. Slot 32 is made sufficiently wide to enable free passage of the upper end of latch plate 18 through slot 32. The inner ends 34, 36 of slot 32 are preferably sloped upwardly as shown in FIGS. 3 and 4. This eases movement of latch plate 18 when rod 28 is displaced as hereinafter explained. Although only one of sloped ends 34, 36 contacts latch plate 18, both ends are advantageously sloped so that either end may be installed over latch plate 18.

Handle 38 may be formed on or pre-fastened to one end of rod 28 by gluing, threading, snap-on fitting, etc. This leaves the opposite end of rod 28 free for passage through gate post 12 as aforesaid. Depending upon the latch construction, it may be necessary to loosen or remove screws 24 in order to prevent latch holder 22 from obstructing passage of rod 28 through gate post 12. Once this has been accomplished, latch plate 18 is aligned within slot 32 and screws 24 are tightened to reattach latch holder 22 to gate post 12. Handle 40 is then fastened over the end of rod 28 opposite handle 38.

Gate posts are conventionally made of 4"×4"lumber, although 6"×6"lumber is used in some cases. Rod 28 may be adapted for use with gate posts of either size. For example, rod 28 may be made long enough to protrude through a 6"×6"gate post, but could be marked for cutting to a reduced size suitable for use with a 4"×4" gate post. A person wishing to use rod 28 with a 6"×6" gate post could do so directly, whereas a person wishing to use rod 28 with a 4"×4" gate post need only cut rod 28 at the marked point.

The operation of the invention is best understood with reference to FIGS. 3 and 4, both of which show gate 10 in the closed position relative to gate post 12. FIG. 3 shows latch plate 18 protruding downwardly through slot 26 to capture latch bolt 16, thereby retaining gate 12 in the closed position.

If an individual wishes to open gate 10, then he need only apply a force to rod 28 in the direction of arrow 42 shown in FIG. 3. If the individual is standing on the same side of gate 10 as the side to which the latch mechanism is fastened (i.e. the left side, as viewed in FIG. 3), then he may press on handle 38 with the palm of the hand to impart the necessary force to rod 28. Alternatively, if the individual is on the opposite side of gate 10, then he may grasp handle 40 and pull to the right (as viewed in FIG. 3) in order to impart the necessary force to rod 28. In either case, sloped surface 34 is displaced to the right, into contact with latch plate 18. Continued displacement of rod 28 gradually lifts latch plate 18 upwardly into the position shown in FIG. 4. As may be seen, latch plate 18 has been lifted clear of slot 26, thereby allowing latch bolt 16 to be withdrawn from slot 26 when a force is applied to open gate 10.

When gate 10 is closed, the leading edge of latch bolt 16 contacts edge 44 (FIG. 4) of latch plate 18, thereby causing latch plate 18 to pivot downwardly through slots 32 and 26 into the closed position (FIG. 3) in which latch bolt 16 is retained and gate 10 thereby held in the closed position. The invention does not impede normal operation of the latch mechanism. For example, while gate 10 is open, handles 38, 40 may be moved into any position, without interfering with the aforesaid operation of the latch mechanism when gate 10 is closed.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A two-way symmetrical gate latch control device for controlling from either side the opening and closing of a pivotal latch plate of a gate latch fixed to a gate post, said device comprising:

(a) a symmetrically shaped rod slidably mountable through an aperture in said gate post such that opposed ends of said rod protrude from opposite sides of said gate post;

(b) removable handle means affixed to each end of said rod, each handle means being larger than said gate post aperture;

(c) a longitudinal slot between the ends and short of the ends of said rod for slidable engagement with said pivotal latch plate; and, (d) each end of said longitudinal slot being adapted respectively for contacting and pivotally displacing said pivotal latch plate upon slidable movement of said rod through said gate post in a required direction to move said pivotal latch plate from a closed position into an open position, and to return said pivotal latch plate from said open position to said closed position upon slidable movement of said rod in an opposite direction.

2. A gate latch control device as defined in claim 1, wherein each end of said slot is sloped.

3. A gate latch control device as defined in claim 2, wherein said handle means are respectively threadably engaged to said ends of said rod.

4. A gate latch control device as defined in claim 2, wherein one sloped end of said slot is concealed within said gate post when said rod is moved to return said pivotal latch plate to said closed position.

* * * * *